US009418634B1

(12) United States Patent
Brebner

(10) Patent No.: US 9,418,634 B1
(45) Date of Patent: Aug. 16, 2016

(54) O-RING TUNING SYSTEM FOR WIND INSTRUMENTS

(71) Applicant: John P. Brebner, Crystal River, FL (US)
(72) Inventor: John P. Brebner, Crystal River, FL (US)

( * ) Notice: Subject to any disclaimer, the term of this patent is extended or adjusted under 35 U.S.C. 154(b) by 0 days.

(21) Appl. No.: 14/639,643

(22) Filed: Mar. 5, 2015

(51) Int. Cl.
*G10D 9/00* (2006.01)
*G10D 7/06* (2006.01)

(52) U.S. Cl.
CPC ..... *G10D 9/005* (2013.01); *G10D 7/06* (2013.01); *G10D 7/066* (2013.01); *G10D 9/00* (2013.01)

(58) Field of Classification Search
CPC ..... G10D 9/00; G10D 9/005; G10D 7/06; G10D 7/066
USPC ..... 84/383 R, 380 R, 382, 386
See application file for complete search history.

(56) References Cited

U.S. PATENT DOCUMENTS 1,103,462 A * 7/1914 Alberti ..... G10D 9/005 84/386
1,374,758 A * 4/1921 Nenneker ..... G10D 9/005 84/386
1,443,122 A * 1/1923 Gemeinhardt ..... G10D 9/005 84/386
1,736,880 A * 11/1929 Gulick ..... G10D 9/005 84/386
1,821,655 A * 9/1931 Loomis ..... G10D 9/005 84/386
1,837,227 A * 12/1931 Loomis ..... G10D 9/005 84/386
1,867,481 A * 7/1932 Todt ..... G10D 9/005 84/386
1,870,211 A * 8/1932 Smith ..... G10D 9/005 84/386
2,036,356 A * 4/1936 Pedler ..... G10D 9/005 84/382
2,098,457 A * 11/1937 Loomis ..... G10D 9/005 84/386
2,485,021 A * 10/1949 Strupe ..... G10D 9/005 84/380 R
2,802,387 A * 8/1957 Bushnell ..... G10D 9/005 84/386
2,943,526 A * 7/1960 Van Caster ..... G10D 9/005 84/386
3,971,288 A * 7/1976 Jones ..... G10D 9/026 84/453
4,258,605 A * 3/1981 Lorenzini ..... G10D 9/00 84/382
4,347,776 A * 9/1982 Grass ..... G10D 9/02 84/383 R
4,401,007 A * 8/1983 Lewis ..... G10D 9/046 84/330
4,449,439 A * 5/1984 Wells ..... G10D 9/02 84/383 R
4,499,810 A * 2/1985 Ferron ..... G10D 7/026 84/384
5,000,072 A * 3/1991 Pascucci ..... G10D 9/00 84/380 R
5,027,685 A * 7/1991 Lenz ..... G10D 9/043 84/330
5,249,499 A * 10/1993 Goldstein ..... G10D 9/005 84/386
5,291,817 A * 3/1994 Smith ..... G10D 9/005 84/386
5,864,076 A * 1/1999 Eder ..... G10D 9/005 84/382
6,054,644 A * 4/2000 Allen ..... G10D 9/00 84/380 R
7,083,492 B1 * 8/2006 Morocco ..... A01M 31/004 446/202
7,148,411 B2 * 12/2006 Hsieh ..... G10D 7/066 84/386
7,563,970 B2 7/2009 Laukat et al.
8,183,449 B2 5/2012 Paulus et al.
8,502,054 B2 8/2013 Warburton
2002/0139237 A1 * 10/2002 Momchilovich ..... G10D 3/16 84/400
2005/0072623 A1 * 4/2005 Rovner ..... G10D 9/02 181/21
2008/0173152 A1 * 7/2008 Laukat ..... G10D 7/005 84/380 R
2010/0229709 A1 * 9/2010 Warburton ..... G10D 7/08 84/385 R
2011/0146473 A1 * 6/2011 Paulus ..... G10D 7/066 84/382

* cited by examiner

*Primary Examiner* — David Warren
*Assistant Examiner* — Christina Schreiber
(74) *Attorney, Agent, or Firm* — Boyle Fredrickson, S.C.

(57) ABSTRACT

A method and apparatus of tuning a wind instrument which stabilizes the mating sections of a jointed instrument when the mating sections are pulled out or pushed in during tuning. At least one O-ring is inserted between the mating sections which seals the interface between the sections to create an air tight seal and firm support between sections. The O-rings may have differing thickness, and any number of O-rings may be used. During tuning, the O-rings may be compressed in order to seal the interface between segments when the segments are pulled out or pushed in with respect to each other.

18 Claims, 4 Drawing Sheets

O-RING TUNING SYSTEM FOR WIND INSTRUMENTS

BACKGROUND OF THE INVENTION

The present invention relates generally to a musical instrument, and more particularly, pertains to a wind instrument tuning system that stabilizes a jointed instrument when the segments of the instrument are pulled out or pushed in to adjust pitch.

Musical instrument tuning is the practice of adjusting the pitch of the tones of an instrument so that proper intervals are established between the tones. Tuning an instrument is typically established against a fixed reference, e.g., Concert A=440 Hz. When an instrument is out of tune, the musical instrument does not match the fixed reference. A pitch or tone that is too high is referred to as "sharp" and a pitch or tone that is too low is referred to as "flat." Instruments can become "out of tune" if they are damaged or worn over time, and must be adjusted or repaired to bring them "in tune." Instruments may also become "out of tune" due to changes in temperature or humidity.

A resonator is a device that oscillates at some frequencies with greater amplitude than others. Resonators are used to generate sounds in a musical instrument, e.g., strings of a guitar, or may be used to modify the sound in a musical instrument, e.g., sound box of a guitar. For wind instruments and brass instruments, an acoustic cavity resonator produces sound via air vibration within a cavity or resonator, which is typically a tube.

One way of manually tuning a woodwind instrument, brass instrument, or similar instrument is to modify the length or width of the instrument's resonator. For example, if a clarinet is playing sharp, a musician will pull out the upper section from the barrel slightly until the clarinet is in tune. Alternatively, the musician can pull out the lower joint from the upper joint, or pull out the bell from the lower joint. If a clarinet is playing flat, the musician will push in the upper section to the barrel (if the barrel is not already fully inserted), or push in other sections of the clarinet, until the clarinet is in tune. If the sections of the clarinet are fully inserted and the instrument is still out of tune, then the musician must improvise by changing his or her embouchure or replacing the barrel with different length sections.

The process of pulling apart or pushing together the mating sections of the instrument takes a toll on the functioning of the instrument. First, the seal between the sections, often times cork seals, get worn over time and must be replaced. Any wear on the cork seal may cause the air tight seal to become permeable, affecting the sound of the instrument. Second, when the mating sections of the instrument are pulled apart, the opposing shoulders of the instrument, which are typically flush when the instrument is fully assembled, are not flush against one another. This results in the joint between the sections being loose and unstable. There is also the potential loss of an air tight seal between the sections. Similarly, this adversely affects the sound of the instrument.

The present invention seeks to improve upon the prior art by providing a novel apparatus which prevents unwanted movement of a jointed instrument when the instrument is in an extended or pulled out state, and helps maintain an air tight seal between mating sections.

It is therefore an object of the present invention to accommodate inward and outward movement of mating sections of an instrument relative to each other while sealing the interface between the mating sections and preventing relative motion ("wobble") between the sections.

It is an additional object of the present invention to enable a musician to pre-tune the instrument to match known pitches of different sources.

SUMMARY OF THE INVENTION

The present invention provides a method and apparatus of tuning a wind instrument which stabilizes the mating sections of a jointed instrument when the mating sections are pulled out or pushed in during tuning. The present invention provides at least one O-ring inserted between the mating sections which seals the interface between the sections to create an air tight seal. The O-rings may have differing thickness, and any number of O-rings may be used. During tuning, the O-rings may be compressed in order to seal the interface between segments when the segments are pulled out or pushed in with respect to each other.

In one embodiment a method of tuning a wind instrument is provided. The method includes providing a wind instrument having a resonator for receiving air. The resonator may be in the form of a column having a mouthpiece and a first section that is coupleable to a second section. The mouthpiece is positioned at a first end of the first section. The next step of the method is to position at least one O-ring between the mouthpiece and first sections of the resonator. Alternatively or in addition, the next step of the method is to position at least one O-ring between the first and second sections of the resonator. Finally, the axial positions of the mouthpiece with respect to the first section and of the second section with respect to the first section are adjusted using the at least one O-ring to vary the length of the resonator.

In one aspect, two or more O-rings may be positioned between the sections of the resonator of varying thickness to create a seal between the sections.

In another aspect, two or more O-rings may be positioned between the sections of the resonator of the same thickness to create a seal between the sections.

In another aspect, the at least one O-ring may be made of rubber. The rubber material may be compressible or non-compressible.

In another aspect, the column has a third section coupleable to the second section and at least one O-ring may be positioned between the second the third sections.

In another aspect, the mouthpiece is coupleable to the first section by inserting a portion of the mouthpiece into a recess of the first section. In another aspect, the first section is coupleable to the second section by inserting a portion of the second section into a recess of the first section.

In another aspect, the axial position of the first section may be adjusted with respect to the mouthpiece by pulling the mouthpiece outward with respect to the first section to increase the length of the resonator. In another aspect, the axial position of the second section may be adjusted with respect to the first section by pulling the second section outward with respect to the first section to increase the length of the resonator.

In another aspect, the axial position of the first section may be adjusted with respect to the mouthpiece by pushing the mouthpiece inward with respect to the first section to decrease the length of the resonator.

In another aspect, the axial position of the second section may be adjusted with respect to the first section by pushing the second section inward with respect to the first section to decrease the length of the resonator.

In another aspect, the wind instrument may be a clarinet.

The present invention also provides a tuning arrangement to stabilize mating sections of any jointed musical instrument with respect to each other. The arrangement contemplates a first section of a musical instrument having a first end and a second end, and a second section of the musical instrument having a first end and a second end. The first end of the second section is connectable to the second end of the first section. The arrangement has a mouthpiece connectable to the first end of the first section. Lastly, the arrangement has at least one O-ring insertable between the mouthpiece and the first section to adjust the overall length of the mouthpiece and first section and to create a seal between the mouthpiece and the first section. Alternatively or in addition, the arrangement has at least one O-ring insertable between the first section and the second section to adjust the overall length of the first and second sections and to create a seal between the first section and the second section.

In one aspect, the connectable end of the mouthpiece has a diameter less than the first end of the first section. In one aspect, the first end of the second section has a diameter less than the second end of the first section.

The present invention also provides a method of tuning a musical instrument, which may be in the form of a wind instrument. The wind instrument has a first section having a first end and a second end, and a second section having a first end and a second end, with the first end of the second section being connectable to the second end of the first section. The wind instrument also has a mouthpiece connectable to the first end of the first section. At least one O-ring may be inserted between the mouthpiece and the first section to create a seal between the mouthpiece and the first section, and for improved stability and/or tuning. Alternatively or in addition, at least one O-ring may be inserted between the first section and the second section to create a seal between the first section and the second section. Lastly, the axial position of the mouthpiece with respect to the first section and the first section with respect to the second section is adjusted using the at least one O-ring in order to change the length of the wind instrument, and the O-ring acts as a stop to maintain the relative position between the mouthpiece, the first section and the second section.

These and other features and aspects of the present invention will be better appreciated and understood when considered in conjunction with the following description and the accompanying drawings. It should be understood, however, that the following description, while indicating a representative embodiment of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
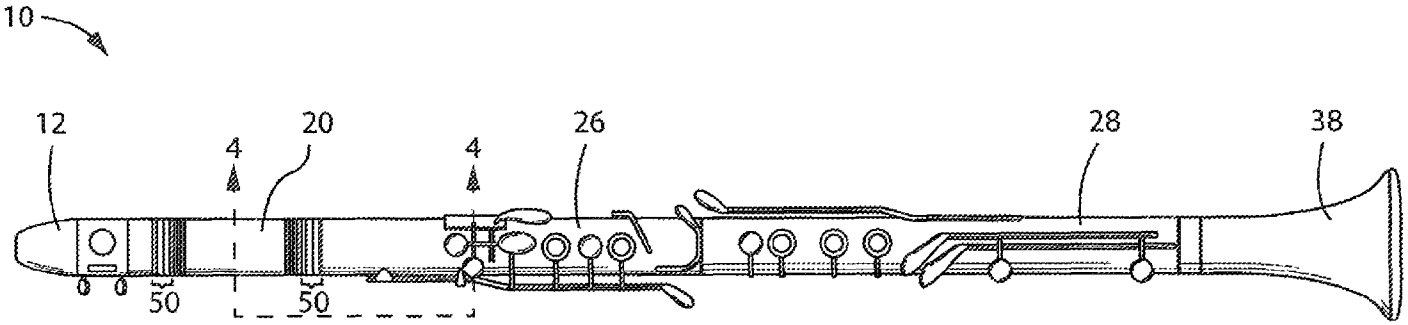
FIG. 1 is a front elevation view of a musical instrument, in the form of a clarinet, according to a first embodiment of the present invention, showing the sections of the clarinet assembled together and three O-rings of varying thickness installed between the mouthpiece and barrel and three O-rings of varying thickness installed between the barrel and upper joint of the clarinet.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION OF THE DRAWINGS

The various features and advantageous details of the subject matter disclosed herein are explained more fully with reference to the non-limiting embodiment described in detail in the following description.

This invention relates generally to a musical instrument, and an apparatus and method of tuning a musical instrument so that the pitches of one or many tones are adjusted to form a desired "in tune" arrangement. More particularly, the present invention is directed to a method of tuning a wind instrument for sealing and stabilizing the mating segments of a jointed instrument when the mating segments are pulled out or pushed in relative to each other to vary the length of the instrument and thereby adjust pitch. The method utilizes one or more O-rings of optionally variable thicknesses and compressibility to reinforce the seal between instrument segments.

Figure 2:
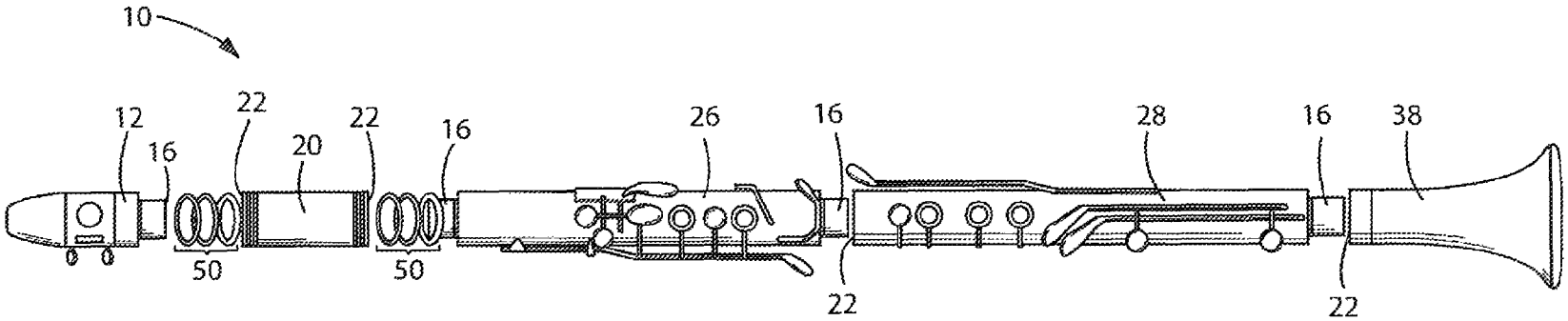
FIG. 2 is an exploded view of the clarinet of FIG. 1, in which the sections of the clarinet are disassembled and the O-rings are removed from the cork tenon of the mouthpiece and the upper joint.

FIG. 1 shows an assembled wind instrument, such as a clarinet 10, having several O-rings 50 installed between mating segments of the instrument. The clarinet 10 has jointed segments which are joined together to form the assembled instrument. In a manner as is known, the clarinet 10 typically has five segments that are joined together consecutively. The segments of the clarinet 10 typically include a mouthpiece 12, a barrel 20, a main body of the clarinet 10 divided into an upper joint 26 and a lower joint 28, and a bell 38. Mating sections of each respective segment of the clarinet 10 are joined in order to assemble the clarinet for playing, as shown in FIG. 1. FIG. 2 shows the disassembled clarinet 10 with the segments disengaged.

The mating sections of the clarinet 10 generally include an attachment end 16 of one segment of the clarinet 10 which is sized for insertion into a receiving end 22 of another segment of the clarinet 10. For example, as shown in FIG. 1-2, the first receiving end 22 of the barrel 20 receives the attachment end 16 of the mouthpiece 12, and the second receiving end 22 of the barrel 20 receives the attachment end 16 of the upper joint 26. The attachment ends 16 of the segments of the clarinet 10 are generally an elongated or tube shape with a reduced diameter adapted to fit within a cavity or recess of the receiving ends 22. Typically, a cork strip or cork tenon is wrapped around the attachment ends 16 to provide a sealed joint between the mating sections. The receiving ends 22 of the segments of the clarinet 10 provide a cavity or recess configured with a complementary cylindrical shape for receiving the attachment ends 16.

As seen in FIGS. 1-2, installed between mating segments of the clarinet 10 are O-rings 50 which are circular or looped rings that are used to create a seal at the interface between mating segments. The O-rings 50 may be installed between any two sections of the clarinet 10, although they may commonly be installed between the mouthpiece 12 and barrel 20, and/or the barrel 20 and the upper joint 26 where the segments are often pulled apart or pushed together for tuning. In particular, the O-rings 50 may be installed around the attachment end 16 of the mouthpiece 12 to encircle the attachment end 16 or cork tenon of the mouthpiece 12. The O-rings 50 are seated between the receiving end 22 of the barrel 20 and a shoulder of the mouthpiece 12. Alternatively or in addition, the O-rings 50 may be installed around the attachment end 16 of the upper joint 26 to encircle the attachment end 16 or cork tenon of the upper joint 26. The O-rings 50 are seated between the receiving end 22 of the barrel 20 and a shoulder of the upper joint 26. While it is shown that three O-rings 50 are installed, any number may be installed between mating clarinet 10 segments, as will be further described below.

While it is contemplated that the O-rings 50 have a generally round cross-section, the cross-section may be different shapes, such as oval or rectangular, and the O-rings 50 may assume different cross-sectional configurations when compressed. The O-rings 50 may be manufactured by extrusion, injection molding, pressure molding, or transfer molding processes, or in any other manner as is known in the art. The O-rings 50 may be made out of, but are not limited to, any of the following rubber or thermoplastic materials: butadiene rubber, butyl rubber, chlorosulfonated polyethylene, epichlorohydrin rubber, ethylene propylene diene monomer, ethylene propylene rubber, fluoroelastomer, nitrile rubber, perfluoroelastomer, polyacrylate rubber, polychloroprene (neoprene), polyisoprene, polysulfide rubber, polytetrafluoroethylene, sanifluor, silicone rubber, styrene butadiene rubber, thermoplastic elastomer styrenics, thermoplastic polyolefin LDPE, HDPE, LLDPE, ULDPE, thermoplastic polyurethane polyether, polyester, thermoplastic etherester-elastomers copolyesters, thermoplastic polyamide polyamides, melt processible rubber, thermoplastic vulcanizate.

In practice, the assembly of the present invention provides a method of tuning a clarinet 10 by sliding the segments of the clarinet 10 inward or outward with respect to each other, and preventing the segments from shifting by creating an air tight seal between mating segments via the O-rings 50. The musician will first assemble the jointed instrument by inserting the attachment ends 16 of the segments into the receiving ends 22 of the corresponding mating segments. The clarinet 10 is often assembled starting at the bell 38 moving upwards, and attaching the lower joint 28 to the bell 38, then the upper joint 26 to the lower joint 28, then the barrel 20 to the upper joint 26, and then the mouthpiece 12 to the upper joint 26. However, the clarinet 10 can be assembled in any order without any practical difference in the assembled instrument.

While assembling the segments of the clarinet 10, the musician may optionally install the desired number of O-rings 50 around the attachment ends 16 of the clarinet so that they encircle the attachment end 16. Then, the musician will insert the attachment end 16 into the receiving end 22 of the corresponding mating segment, such as between the mouthpiece 12 and barrel 20, and between the barrel 20 and the upper joint 26. The mating segments may be pushed inward with respect to each other so as to compress the O-rings 50 and produce a tight seal between the segments. Although the shoulders (corresponding faces of the segments which would normally be flush against each other when the segments are fully inserted within each other) of mating segments do not contact, the O-rings 50 positioned therebetween provide an air tight seal. While the O-rings 50 are shown being installed between the mouthpiece 12 and barrel 20, and the barrel 20 and upper joint 26 only in FIGS. 1-2, the musician may install O-rings between any of the mating segments in a similar manner.

Figure 3:
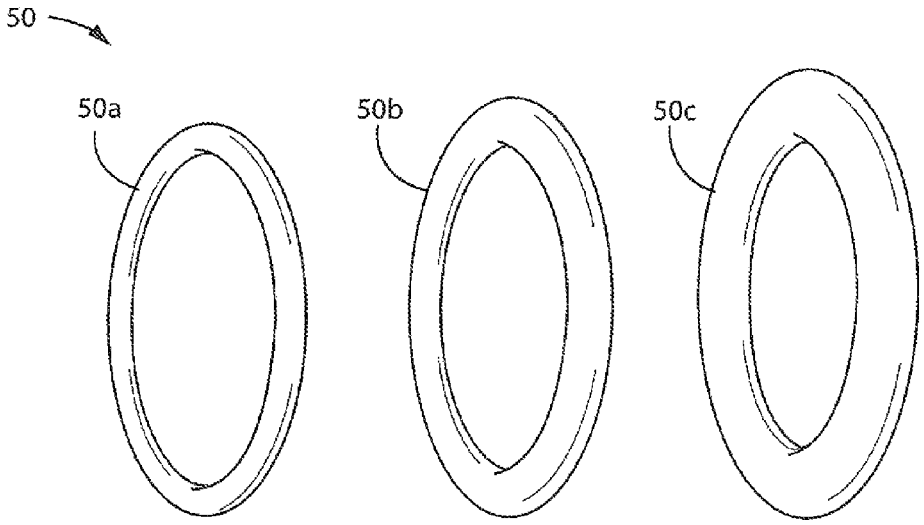
FIG. 3 is a schematic illustration of three O-rings of varying thicknesses.

FIG. 3 shows three O-rings 50 having varying thicknesses, O-ring 50*a* having the least thickness, O-ring 50*b* with medium thickness, and O-ring 50*c* having the greatest thickness. The inner diameter of the O-rings 50 may generally conform to the diameter of the mating section of the instrument which the O-ring 50 will be installed on so that the O-ring will produce a snug fit around the mating section. The outer diameter of the O-rings 50 may vary to vary the thickness of the O-ring 50. The varying thicknesses or widths of the O-rings 50 allow the O-rings 50 to be installed on various wind instruments and at different mating sections of the instrument which may have varying widths. Also, the inner diameter of the O-rings may vary so that the O-rings 50 can be installed on wind instruments of different diameters, sizes and shapes. The O-rings 50 of varying thicknesses may be color-coded so that O-rings have different colors identifying different thicknesses.

Figure 4:
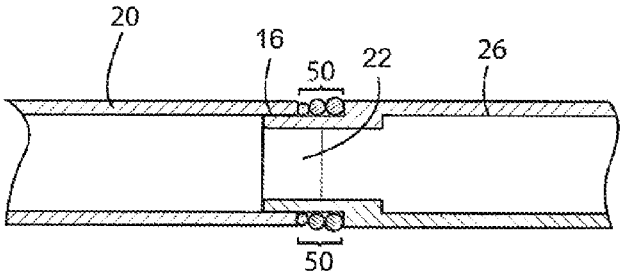
FIG. 4 is a sectional view taken along the cross section as indicated at line 4-4 in FIG. 1, showing three O-rings of varying thickness inserted around the cork tenon of the upper joint and installed between the barrel and upper joint of the clarinet.
Figure 5:
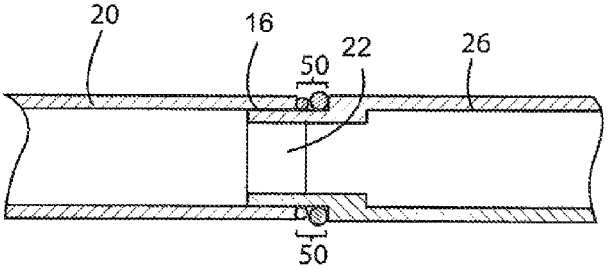
FIG. 5 is a sectional view similar to FIG. 4, showing two O-rings inserted around the cork tenon of the upper joint and installed between the barrel and upper joint of the clarinet.

As seen in FIGS. 4-5, showing the cross-section of the clarinet 10 of FIG. 1, any appropriate number of O-rings 50 may be installed between segments of the clarinet 10 to provide the desired degree of tuning. For example, three O-rings 50, each of varying thickness, may be installed between the barrel 20 and the upper joint 26, as seen in FIG. 4. Alternatively, two O-rings 50, both of varying thickness, may be installed between the barrel 20 and upper joint 26, as seen in FIG. 5. While FIGS. 4-5 show the O-rings 50 being installed between the barrel 20 and the upper joint 26, it is understood that installation of the O-rings 50 between any two mating segments is done in a similar manner. The number of O-rings 50 installed may correspond with the distance that the segments will be pulled apart with respect to each other for required tuning. For example, if the segments do not need to be pulled out a very far distance, then fewer O-rings may be installed, whereas if the segments need to be pulled out a further distance, then additional O-rings may be installed.

Once the clarinet 10 is fully assembled, in order to tune the assembled instrument, the musician will choose a note or series of notes to tune to. By using a tuner or listening by ear, the musician determines if he or she is in tune. If the clarinet 10 is not in tune, then the musician will determine if they are sharp or flat. When the clarinet 10 is sharp, the upper segment (s) are pulled out slightly so that the instrument is lengthened, and one or more additional O-rings 50 may be installed if required. When the clarinet 10 is flat, the segment(s) are pushed together slightly so that the instrument is shortened, compressing the O-rings 50, or one or more of the O-rings 50 may be removed if desired. It is most common to adjust the length of the clarinet 10 by pulling out or pushing in the mouthpiece 12 with respect to the upper joint 26 or by pulling out or pushing in the upper joint 26 with respect to the barrel 20.

Figure 6:
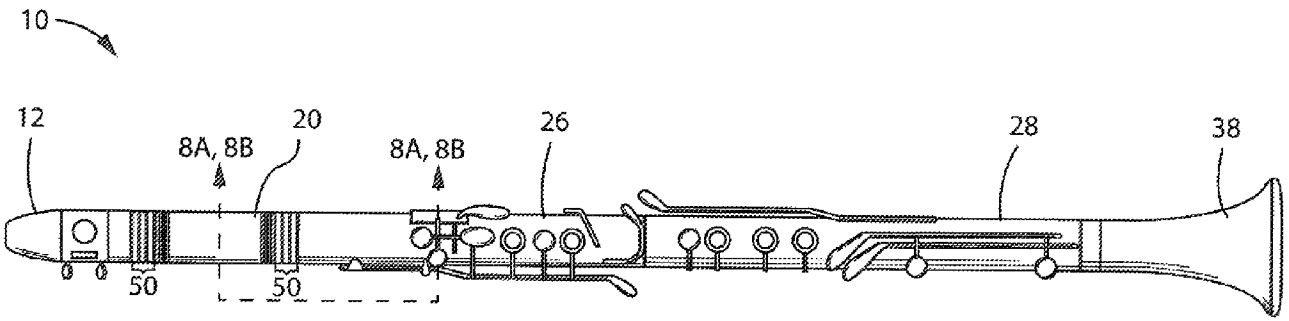
FIG. 6 is a front elevation view of a clarinet, according to a second embodiment of the present invention, showing the sections of the clarinet assembled together and three O-rings of the same thickness installed between the mouthpiece and barrel and three O-rings of the same thickness installed between the barrel and upper joint of the clarinet.
Figure 7:
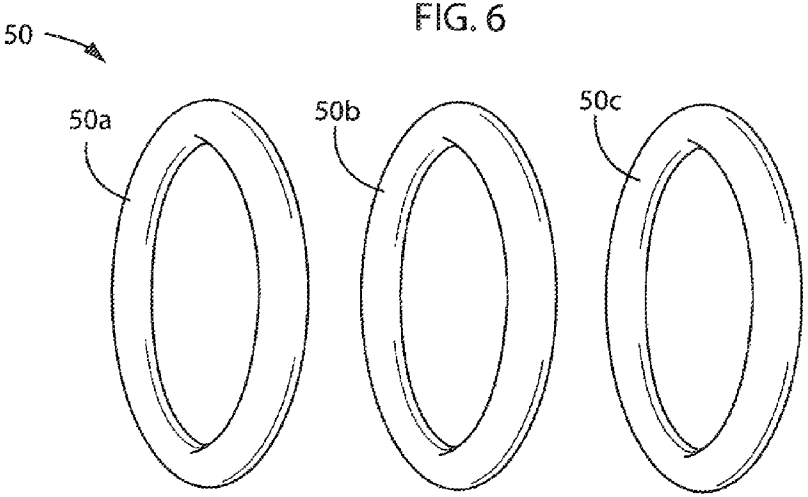
FIG. 7 is a schematic illustration of three O-rings of the same thicknesses.
Figure 8A:
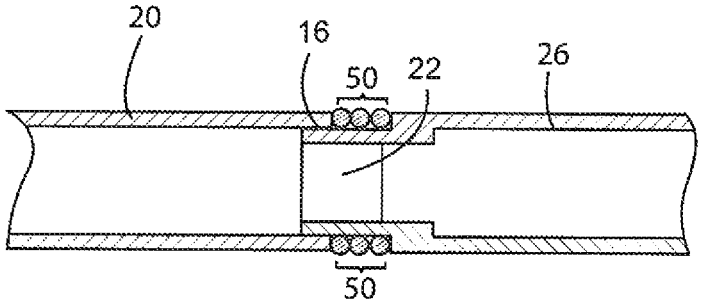
FIG. 8*a* is a sectional view taken along the cross section as indicated at line 8*a*-8*a* in FIG. 6, showing three O-rings of the same thickness inserted around the cork tenon of the upper joint and installed between the barrel and upper joint of the clarinet.
Figure 8B:
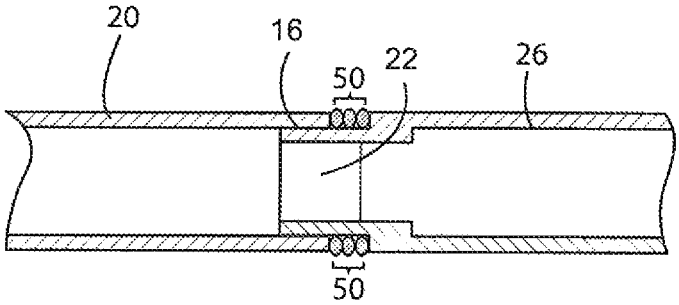
FIG. 8*b* is a sectional view taken along the cross section as indicated at line 8*b*-8*b* in FIG. 6, showing three O-rings of the same thickness inserted around the cork tenon of the upper joint and installed between the attached barrel and upper joint of the clarinet and in a compressed state.
Figure 9A:
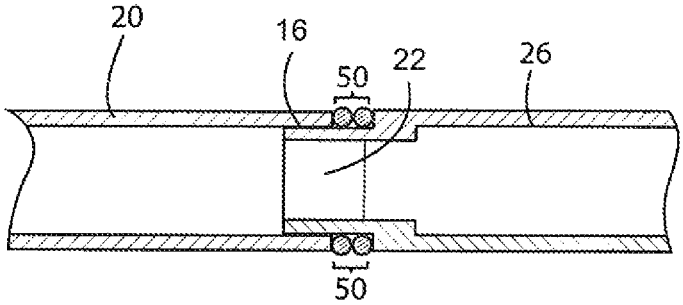
FIG. 9*a* is a sectional view similar to FIG. 8*a*, showing two O-rings inserted around the cork tenon of the upper joint and installed between the barrel and upper joint of the clarinet.
Figure 9B:
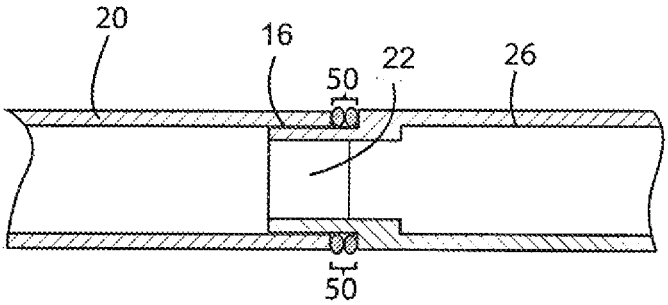
FIG. 9*b* is a sectional view similar to FIG. 8*b*, showing two O-rings inserted around the cork tenon of the upper joint and installed between the barrel and upper joint of the clarinet and in a compressed state.

While the O-rings 50 may be made of a material that maintains its stiffness when the segments of the clarinet 10 are pushed together, such as a plastic material, the O-rings may also be made of a material that may compress when the segments are pushed together, such as a rubber material. Referring to FIGS. 6 and 7, the O-rings 50*a*, 50*b*, 50*c* may be the same thickness but may be made out of a material that is more compressible. As seen in FIG. 8A, showing the cross-section of the clarinet 10 of FIG. 6, three O-rings 50 are installed between the barrel 20 and the upper joint 26. As seen in FIG. 8B, when the upper joint 26 is pushed into the barrel 20 to a further extent, the O-rings 50 are compressed. As seen in FIG. 9A, two O-rings 50 are installed between the barrel 20 and the upper joint 26. As seen in FIG. 9B, when the upper joint 26 is pushed into the barrel 20 to a further extent, the O-rings 50 are compressed. Compression of the O-rings 50 allows the user to easily fine-tune the instrument by pulling out or pushing together the mating segments, while maintaining the seal of the O-rings 50 between the segments ("wobble"). While FIGS. 8A-9B show the O-rings 50 being installed between the barrel 20 and the upper joint 26, it is understood that installation of the O-rings 50 between any two mating segments is done in a similar manner.

It is appreciated that the O-rings 50 assist to provide an air tight seal between the jointed segments of a musical instrument. Moreover, the O-rings 50 may be compressible to allow for flexibility when the mating segments are pulled out or pushed in for tuning purposes. Moreover, the O-rings 50 help to provide stability between segments of the instrument and prevent relative motion of the segments.

While the tuning system has been shown to be used in connection with a clarinet 10, it is contemplated that the system may be used with any wind instrument, such as woodwind instruments (e.g., recorders, flutes, oboes, saxophones, and bassoons) or brass instruments (e.g., horns, trumpets, trombones, euphoniums, and tubas). The O-rings 50 may be installed between any jointed segments of the wind instrument.

Many changes and modifications could be made to the invention without departing from the spirit thereof. The scope of these changes will become apparent from the appended claims.

I claim:

1. A method of tuning and stabilizing mating sections of a jointed musical instrument comprising the steps of:

providing a wind instrument comprising a resonator for receiving air therethrough and having a first section coupleable to a second section, wherein a first end of the second section defines a first annular engagement surface and a second end of the first section defines a second annular engagement surface, wherein the first and second annular engagement surfaces face each other when the first end of the second section is connected to the second end of the first section, and one of the sections includes a neck portion and the other of the sections includes a passage within which the neck portion is received for coupling the first and second sections together;

positioning at least one compressible O-ring about the neck portion such that the at least one compressible O-ring is located between the first and second annular engagement surfaces;

applying an axial force on the first and second sections to advance the neck portion into the passage;

continuing to apply the axial force on the first and second sections to move the first and second sections together, wherein movement of the first and second sections together is operable to bring the first and second annular engagement surfaces into contact with the at least one compressible O-ring, wherein the at least one compressible O-ring creates a seal between the first section and the second section at the first and second annular engagement surfaces; and varying the axial position of the first section with respect to the second section while maintaining contact between the at least one compressible O-ring and the first and second annular engagement surfaces, wherein varying the axial position of the first section with respect to the second section selectively compresses the at least one compressible O-ring and varies a width defined by the at least at least one compressible O-ring and thereby an overall length defined by the first and second sections to adjust tuning of the musical instrument, and wherein maintaining contact between the at least one compressible O-ring and the first and second engagement surfaces while varying the axial position of the first section relative to the second section maintains the seal between the first section and the second section.

2. The method of claim 1 wherein a mouthpiece is coupleable to a first end of the first section by inserting a portion of the mouthpiece into a recess in the first end of the first section.

3. The method of claim 2 wherein alignment of the mouthpiece is adjusted with respect to the first section by pulling the mouthpiece outward with respect to the first section to increase an overall length of the resonator.

4. The method of claim 2 wherein alignment of the mouthpiece is adjusted with respect to the first section by pushing the mouthpiece inward with respect to the first section to decrease an overall length of the resonator.

5. The method of claim 1 further comprising the step of positioning at least two compressible O-rings of different thickness between the first section and the second section to create a seal between the first section and the second section.

6. The method of claim 1 further comprising the step of positioning at least two compressible O-rings of the same thickness between the first section and the second section to create a seal between the first section and the second section.

7. The method of claim 1 wherein the wind instrument is a clarinet.

8. An arrangement for tuning and stabilizing mating sections of a jointed musical instrument with respect to each other, comprising:

a first section of the musical instrument having a first end and a second end;

a second section of the musical instrument having a first end and a second end, wherein the first end of the second section is connectable to the second end of the first section;

wherein the first section includes a neck portion and the second section includes a passage within which the neck portion of the first section is received for coupling the first and second sections together;

wherein the first end of the second section defines a first annular engagement surface about the neck portion and the second end of the first section defines a second annular engagement surface about the passage, wherein the first and second annular engagement surfaces face each other when the first end of the second section is connected to the second end of the first section; and at least one compressible O-ring positioned about the neck portion and between the first and second annular engagement surfaces, wherein application of an axial force on the first and second sections advances the neck portion of the first section into the passage of the second section and brings the first and second annular engagement surfaces into contact with the at least one compressible O-ring to place the first and second sections in a first position in which the at least one compressible O-ring creates a seal between the first and second sections together, and wherein continued application of the axial force on the first and second section is operable to compress the at least one compressible O-ring between the first and second annular engagement surfaces to place the first and second sections in a second position in which an overall length defined by the connected first and second sections is shortened relative to the first position to alter the pitch of the musical instrument.

9. The arrangement of claim 8 wherein a mouthpiece defines a connectable end that is insertable into a recess of the first end of the first section.

10. The arrangement of claim 9 wherein the first end of the first section has a diameter greater than a diameter of the connectable end of the mouthpiece.

11. The arrangement of claim 9 wherein a compressible O-ring is installed around the connectable end of the mouthpiece.

12. The arrangement of claim 9 wherein at least two compressible O-rings are positioned about the neck portion and between the first and second annular engagement surfaces.

13. A method of tuning and stabilizing a musical instrument comprising the steps of:

providing a wind instrument comprising:

a first section having a first end and a second end;

a second section having a first end and a second end wherein the first end of the second section is connectable to the second end of the first section, wherein one of the sections defines a neck portion and the other of the sections defines a passage within which the neck portion is received for coupling the first and second sections together;

wherein the first end of the second section defines a first annular engagement surface and the second end of the first section defines a second annular engagement surface, wherein the first and second annular engagement surfaces face each other when the first end of the second section is connected to the second end of the first section; and placing at least one compressible O-ring about the neck portion such that the at least one compressible O-ring is located between the first and second annular engagement surfaces;

applying an axial force on the first and second sections to advance the neck portion into the passage;

continuing to apply the axial force on the first and second sections to move the first and second sections together, wherein movement of the first and second sections together is operable to bring the first and second annular engagement surfaces into contact with the at least one compressible O-ring, wherein the at least one compressible O-ring creates a seal between the first section and the second section at the first and second annular engagement surfaces; and varying the axial position of the first section with respect to the second section while maintaining contact between the at least one compressible O-ring and the first and second annular engagement surfaces in order to change an overall length defined by the connected first and second sections, wherein varying the axial position of the first section with respect to the second section while maintaining contact between the at least one compressible O-ring and the first and second annular engagement surfaces is carried out by selectively applying an axial force on the first and second sections in a first direction tending to move the first and second sections together and thereby compress the at least one compressible O-ring to a first thickness or in a second direction tending to move the first and second sections apart and thereby compress the at least one compressible O-ring to a second thickness greater than the first thickness, wherein the at least one compressible O-ring is maintained in engagement with the first and second annular surfaces during application of the axial forces in both the first direction and the second direction, and the change in the overall length defined by the first and second sections adjusts tuning of the musical instrument, and wherein maintaining contact between the at least one compressible O-ring and the first and second engagement surfaces while varying the axial position of the first section relative to the second section maintains the seal between the first section and the second section.

14. The method of claim 13 wherein at least two compressible O-rings are positioned between the first section and the second section.

15. The method of claim 14 wherein the at least two compressible O-rings are of varying thicknesses.

16. The method of claim 14 wherein the at least two compressible O-rings are of the same thicknesses.

17. The method of claim 13 wherein application of the axial force to the first and second sections in the second direction functions to increase the length of the musical instrument.

18. The method of claim 13 wherein application of the axial force to the first and second sections in the first direction functions to decrease the length of the musical instrument.

* * * * *